US012446692B2

(12) United States Patent
Wingard

(10) Patent No.: US 12,446,692 B2
(45) Date of Patent: Oct. 21, 2025

(54) HEIGHT ADJUSTMENT MECHANISM FOR FURNITURE

(71) Applicant: E.C. Woods, Inc., Middlebury, IN (US)

(72) Inventor: Ernest Wingard, Syracuse, IN (US)

(73) Assignee: E.C. Woods, Inc., Middlebury, IN (US)

( * ) Notice: Subject to any disclaimer, the term of this patent is extended or adjusted under 35 U.S.C. 154(b) by 191 days.

(21) Appl. No.: 18/130,712

(22) Filed: Apr. 4, 2023

(65) Prior Publication Data

US 2024/0335038 A1 Oct. 10, 2024

(51) Int. Cl.
*A47C 1/026* (2006.01)
*A47C 1/029* (2006.01)

(52) U.S. Cl.
CPC ..... *A47C 1/026* (2013.01); *A47C 1/029* (2013.01)

(58) Field of Classification Search
CPC ..... A47C 1/026; A47C 1/14; A47C 1/143
See application file for complete search history.

(56) References Cited

U.S. PATENT DOCUMENTS 845,039 A 2/1907 Leavitt
2,608,237 A * 8/1952 Lecroy ..... A47C 1/026 297/411.42
4,034,948 A 7/1977 Brownell
4,296,694 A * 10/1981 Kobayashi ..... G10G 7/00 984/258
4,387,888 A * 6/1983 Marinakis ..... A61G 13/08 5/613
4,561,621 A 12/1985 Hill
4,776,634 A * 10/1988 Pugliese ..... A47C 1/026 297/359
5,971,485 A * 10/1999 Clark ..... A61G 13/009 297/195.11
8,029,062 B2 10/2011 Appelqvist et al.
9,282,822 B2 3/2016 Hogue
9,375,088 B2 * 6/2016 Andoloro ..... A47C 1/026

FOREIGN PATENT DOCUMENTS

WO 2008/001093 A1 1/2008

* cited by examiner

*Primary Examiner* — David R Dunn
*Assistant Examiner* — Tania Abraham
(74) *Attorney, Agent, or Firm* — TAYLOR & EDELSTEIN, PC

(57) ABSTRACT

A furniture device includes: a movable device; a height adjustment mechanism operably coupled with the movable device and configured for supporting the movable device in a plurality of positions including a lower position and an upper position, the height adjustment mechanism including: a ratchet defining a plurality of stations including a lower station and an upper station corresponding respectively to the upper position and the lower position; a rod configured for selectively engaging the plurality of stations; and a rod return device configured for pivoting and thereby for returning the rod to the upper station.

9 Claims, 7 Drawing Sheets

HEIGHT ADJUSTMENT MECHANISM FOR FURNITURE

BACKGROUND OF THE INVENTION

1. Field of the Invention

The present invention relates to furniture, and, more particularly, to height adjustment mechanisms for furniture.

2. Description of the Related Art

U.S. Pat. No. 4,034,948 (Brownell) discloses a vehicle seat structure including a seat and a base. To adjust a tilt of the seat, a user moves a lever up, which causes an actuator bar to rotate about a pin and to contact a tilt select pin, and with enough force applied to the lever to counteract a spring the lever thereby causes the tilt select pin to change notches by the actuator bar. When the lever is released, the tilt select pin is drawn into the new notch by the spring, which thereby also returns the actuating bar and the ever to their original positions, and as a result the new tilt position of the seat becomes fixed. A problem with this arrangement is its complexity.

What is needed in the art is a height adjustment mechanism which elegantly and cost-effectively enables adjustment of the height of at least a portion of a piece of furniture.

SUMMARY OF THE INVENTION

The present invention provides a height adjustment mechanism of a piece of furniture, the height adjustment mechanism including a ratchet, a rod, and a rod return device that is pivotable.

The invention in one form is directed to a furniture device includes: a movable device; a height adjustment mechanism operably coupled with the movable device and configured for supporting the movable device in a plurality of positions including a lower position and an upper position, the height adjustment mechanism including: a ratchet defining a plurality of stations including a lower station and an upper station corresponding respectively to the upper position and the lower position; a rod configured for selectively engaging the plurality of stations; and a rod return device configured for pivoting and thereby for returning the rod to the upper station.

The invention in another form is directed to a height adjustment mechanism of a furniture device, the furniture device including a movable device, the height adjustment mechanism being operably coupled with the movable device and configured for supporting the movable device in a plurality of positions including a lower position and an upper position, the height adjustment mechanism including: a ratchet defining a plurality of stations including a lower station and an upper station corresponding respectively to the upper position and the lower position; a rod configured for selectively engaging the plurality of stations; and a rod return device configured for pivoting and thereby for returning the rod to the upper station.

The invention in yet another form is directed to a method of using a furniture device, the method including the steps of: providing a movable device and a height adjustment mechanism operably coupled with the movable device and configured for supporting the movable device in a plurality of positions including a lower position and an upper position, the height adjustment mechanism including a ratchet, a rod, and a rod return device, the ratchet defining a plurality of stations including a lower station and an upper station corresponding respectively to the upper position and the lower position; engaging selectively, by the rod, the plurality of stations; and pivoting the rod return device and thereby returning the rod to the upper station.

An advantage of the present invention is that it is elegantly simple and cost-effective.

Another advantage is that the ratchet is configured to deliver the rod to the rod return device and to cause the rod return device to return the rod to the ratchet.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
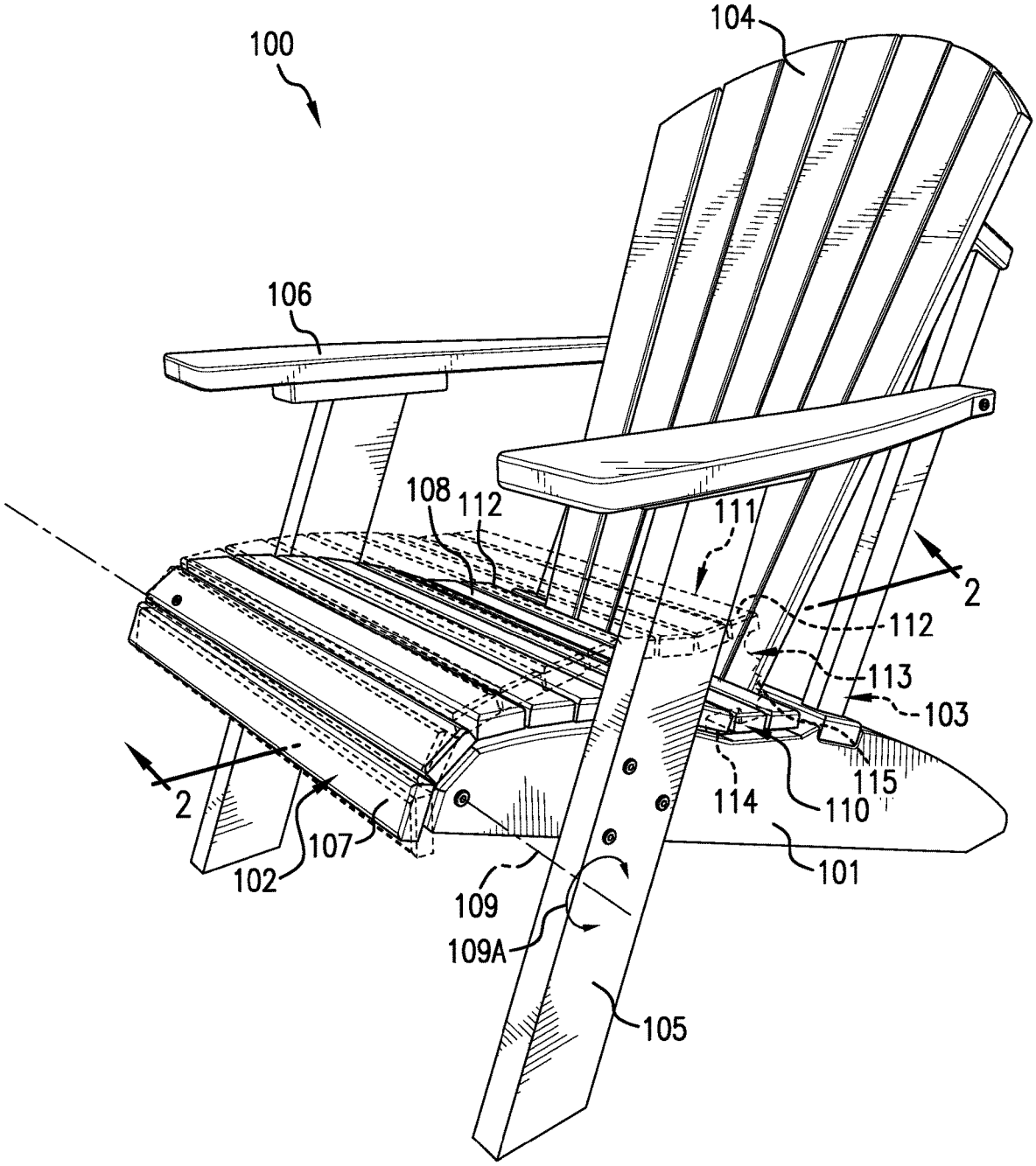
FIG. 1 is a perspective view of a furniture device, the furniture device including a base, a movable device, and a height adjustment mechanism, in accordance with an exemplary embodiment of the present invention.

Referring now to the drawings, and more particularly to FIG. 1, there is shown a furniture device 100 which generally includes a base 101, a movable device 102, and a height adjustment mechanism 103. According to this embodiment of the present invention, furniture device 100 is a chair, such as an outdoor lounge chair, and movable device 102, then, is a seat. Chair 100 further includes a backrest 104, front legs 105, and armrests 106. Chair 100 can be made of any suitable material and in any suitable manner. Optionally, chair 100 can be largely made of polymer material, such as base 101, seat 102, height adjustment mechanism 103, backrest 104, front legs 105, and armrests 106 (though fasteners, rod 114 (below), and/or any pivot rods may optionally be metallic). Unless otherwise described herein or shown in the figures, left and right sides of the embodiment of chair 100 shown in FIG. 1 mirror one another, such that a description or showing of one side serves as a description or showing of the other side as well.

As shown in FIG. 1, base 101 serves as a foundation for one or more portions of chair 100. For instance, as shown, base 101, according to the present embodiment, serves as a foundation for seat 102 and backrest 104, as well as for one or more portions of height adjustment mechanism 103.

Seat 102 is coupled with base 101 and is configured for pivoting relative to base 101. More specifically, seat 102 includes a front end 107 and a back end 108. Front end 107 is pivotably coupled with base 101 in any suitable manner such that seat 102 can selectively pivot about a pivot axis 109 relative to base 101 at front end 107, as indicated by double arrow 109A. For instance, front end 108 can be coupled with base 101 by way of a single pivot rod extending through each side (left and right) of base 101 and through front end 107 of seat 102 (the single pivot rod being attached to left and right sides of base 101 using, for example, any suitable fasteners), or, alternatively, left and right bolts (rather than a single pivot rod) can extend respectively through left and right sides of base 101 and left and right sides of seat 102 (the two bolts being attached to left and right sides of base 101 using, for example, any suitable fasteners, such as nuts, or the like). Seat 102, in solid lines, is shown in FIG. 1 in a lower position 110; more specifically, back end 108 is shown pivoted downward, such that seat is in the lower position 110. In broken lines, seat 102 is also shown pivoted to a raised and released position 111, such that a rod 114 of height adjustment mechanism 103 is no longer seated in a respective station 115 of a ratchet 113 of height adjustment mechanism 103 by a user (a user can move seat 102 to position 111 in order to return seat 102 to lower position 110 after seat 102 has been in a higher position). The user can grasp back end 108, by way of example, at area 112 of back end 108 with a hand in order to raise and lower seat 102 selectively. Thus, the height of seat 102 is able to be adjusted by height adjustment mechanism 103 in the sense that back end 108 can be raised or lowered by pivoting front end 107 about pivot axis 103; it can be appreciated that this way of adjusting the height of back end 108 can also be referred to as tilting seat 102. Further, because left and right sides of chair 100 mirror one another, left and right sides of seat 102 include a ratchet 113 (left side ratchet 113 being shown in FIG. 1, and right side ratchet 113 being shown in subsequent figures, though a description of one ratchet 113 serves as a description of the other ratchet 113, unless shown and/or described otherwise.

Height adjustment mechanism 103 is partially shown in FIG. 1. More specifically, height adjustment mechanism 103 is shown to include ratchet 113 and rod 114. As indicated, according to the embodiment of the present invention shown in FIG. 1, ratchet 113 is formed as a part of seat 102 and includes or defines a plurality of stations 115 (though four stations 115 are shown in the embodiment of FIG. 1, it can be appreciated that more or less such stations can be in the ratchet). Thus, not only does height adjustment mechanism 103 include ratchet 113, but so also does seat 102 form ratchet 113. When back end 108 of seat 102 is secured in position such that user can sit in seat 102, rod 114 is seated within a respective one of stations 115. Height adjustment mechanism 103 is operably coupled with seat 102 at all times, regardless of whether seat 102 is in raised and released position 111 or seated in a respective station 115.

Figure 2:
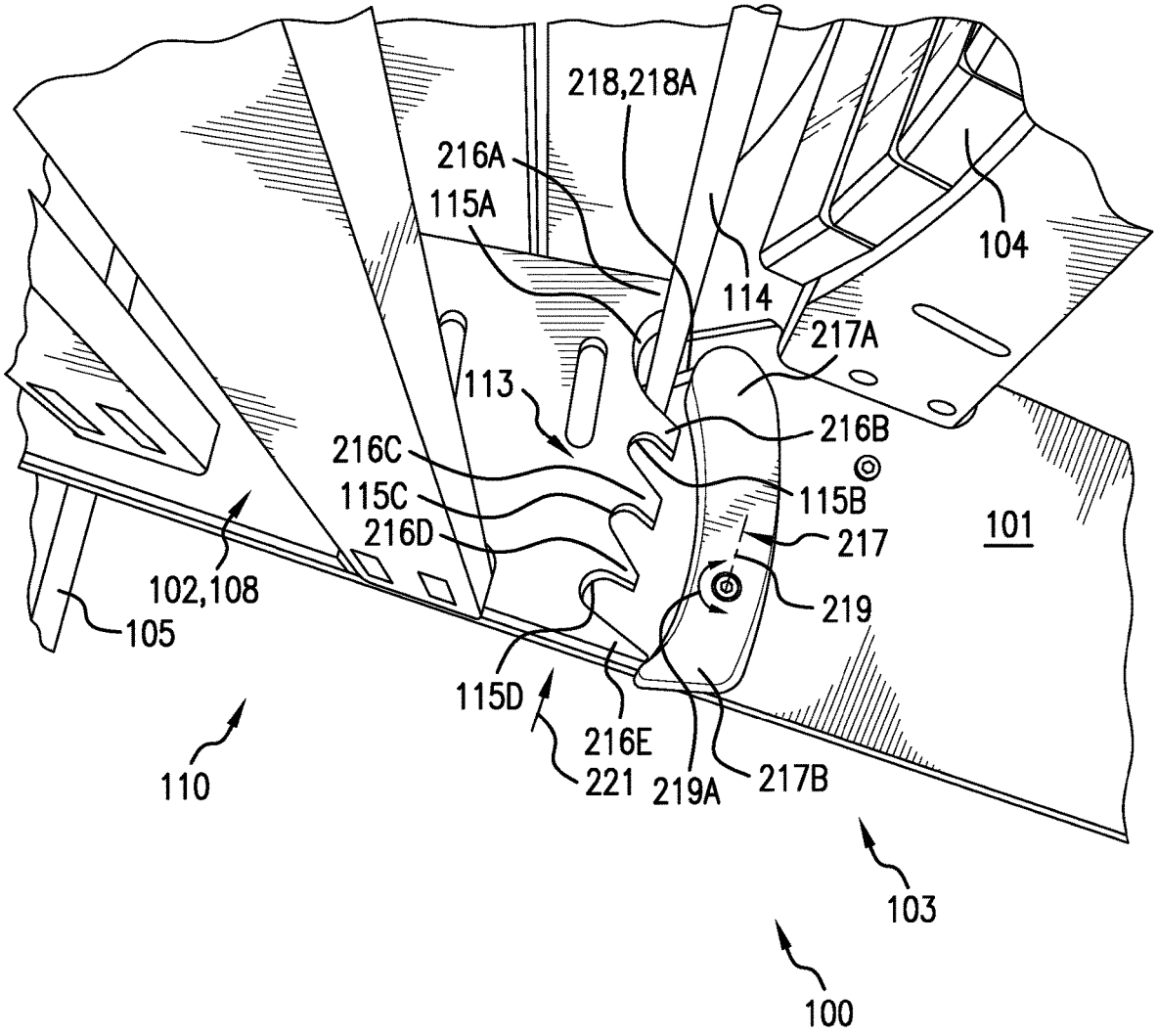
FIG. 2 is a perspective view of the furniture device of FIG. 1, more specifically the perspective view being taken from a vantage point at approximately a cross-section taken along line 2-2 in FIG. 1, with portions broken away, in accordance with an exemplary embodiment of the present invention.

Referring now to FIG. 2, there is shown a perspective view of chair 100 of FIG. 1, more specifically the perspective view being taken from a vantage point at approximately a cross-section taken along line 2-2 in FIG. 1, with portions broken away. Thus, only a portion of chair 100 is shown, looking toward the right side of chair 100 (the front of chair 100 being to the left in FIG. 2), from generally under seat 102 and backrest 104. Seat 102 is shown to be in lower position 110, and back end 108 is shown as well. Height adjustment mechanism 103 is configured for supporting seat 102 in a plurality of positions including lower position 110 and an upper position 320 (FIG. 3), and at intermediate positions therebetween. Height adjustment mechanism 103 is shown to include ratchet 113 (it can be appreciated that both height adjustment mechanism 103 and seat include ratchet 113), rod 114, and rod return device 217. Ratchet 113 includes stations 115, which include stations 115A, 115B, 115C, 115D, with station 115A being an upper station 115A, station 115D being a lower station 115D, and stations 115B, 115C being intermediate stations 115C, 115D therebetween. Upper station 115A and lower station 115D correspond respectively to lower position 110 of seat 102 and upper position 320 of seat 102, and intermediate stations 115B, 115C correspond respectively to intermediate positions of seat 102. Ratchet 113 further includes teeth 216A, 216B, 216C, 216D, 216E which define stations 115A, 115B, 115C, 115D, 115E therebetween, with station 115A being between teeth 216A and 216B, station 115B being between teeth 216B and 216C, station 115C being between teeth 216C and 216D, and station 115D being between teeth 216D and 216E. Stations 115 are each configured for being that in which rod 114 is seated and thereby positioned so as to provide a position for seat 102 (stations 115 can also be referred to as seats or slots).

Figure 3:
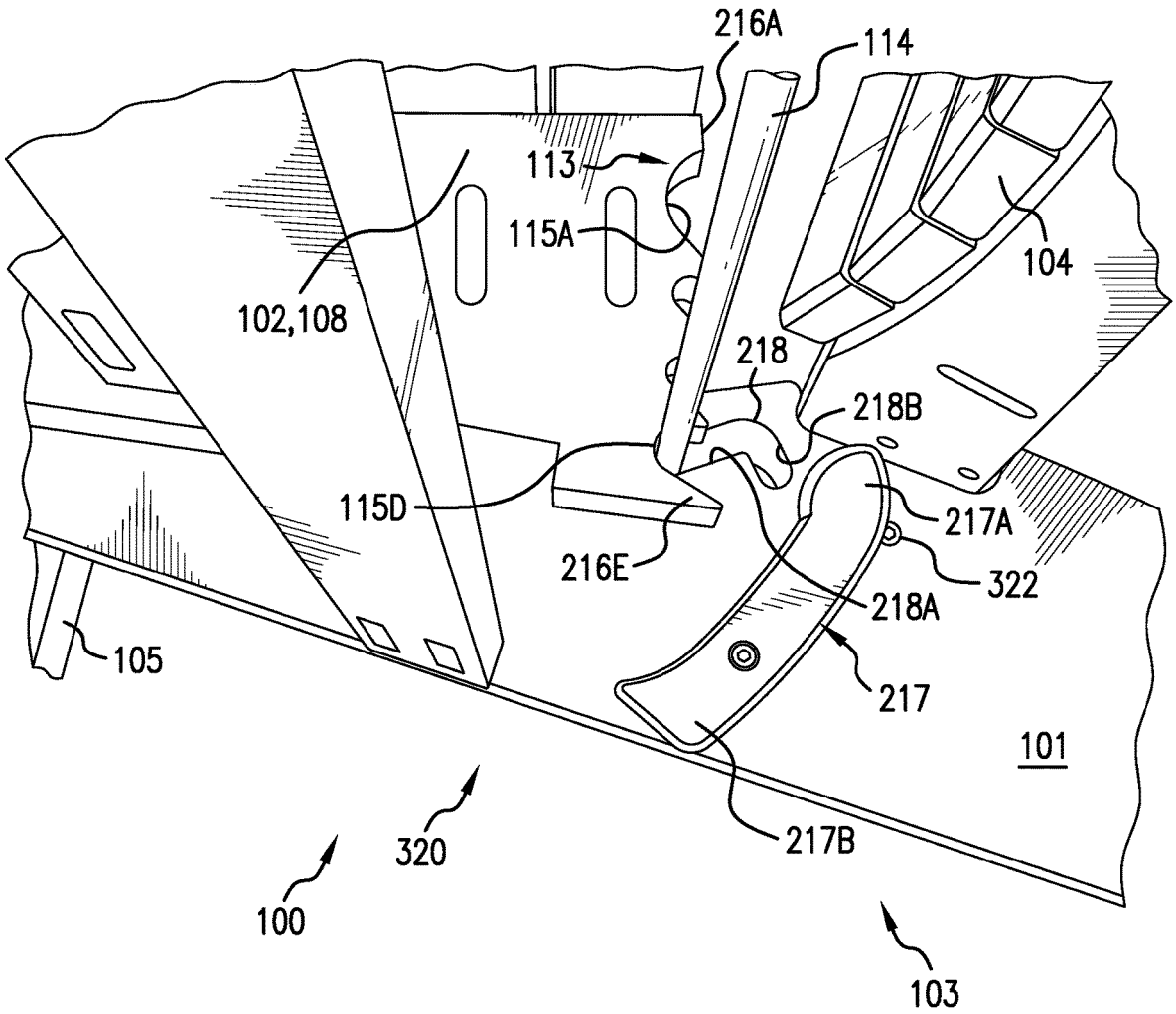
FIG. 3 is a perspective view of the furniture device of FIG. 1, more specifically the perspective view being taken from a vantage point at approximately a cross-section taken along line 2-2 in FIG. 1, with portions broken away, except that the movable device has been raised to an upper position of seat, in accordance with an exemplary embodiment of the present invention.

Rod 114 is an elongate bar or tube. Rod 114 is made of any suitable material, such as steel. Rod 114 moves between stations 115 in order to adjust the height (or tilt) of seat 102. In FIG. 2, rod 114 is positioned in station 115A, such that seat 102 is in lower position 110. Thus, rod 114 is configured for selectively engaging stations 115 and is thus movable relative to ratchet 113. Rod 114 is also movable relative to base 101. More specifically, rod 114 is movably coupled with base 101 by way of a groove 218 formed by base 101, such that base 101 defines and includes groove 218. Because the left and right sides of chair 100 mirror each other, left and right sides of base 101 each have an inwardly facing groove 218, the groove shown in FIG. 2 being formed in the right side of base 101 (thus, a description of one groove 218 serves as a description of the other groove 218, unless shown and/or described otherwise). Groove 218 can be formed in base 101 in any suitable manner, such as by way of molding or cutting. Groove 218 can have an angular configuration (more visible in FIG. 3), such as a generally or substantially L-shaped configuration, including a front leg 218A (partly visible in FIG. 2) and a back leg 218B (FIG. 3). Thus, left and right ends of rod 114 move within corresponding grooves 218 in left and right sides of base 101, and because left and right sides of chair 100 mirror one another a description of one end of rod 114 serves as a description of the other end of rod 114, unless shown and/or described otherwise. Each end of rod 114 is configured for sliding within a respective groove 218.

Rod return device 217 is pivotably coupled with base 101. More specifically, left and right sides of chair 100 include a respective rod return device 217 coupled with a respective one of the left and right sides of base 101; thus, a description of one rod return device 217 serves as a description of the other, unless described and/or shown otherwise. Rod return device 217 is configured for pivoting and thereby for returning rod 114 to upper station 115A (as explained more fully below). Rod return device 217 is coupled with base 101 in any suitable manner, including pivot pins, pivot rods, fasteners, and the like, and defines a pivot axis 219 about which rod return device can pivot in either direction, as indicated by double arrow 219A. Rod return device 217 includes an upper end 217A and a lower end 217B. As shown, rod return device 217 can have a generally elongate and gently curved configuration. Upper end 217A is configured for engaging rod 114. Lower end 217B is configured for being engaged by a respective one of teeth 216A, 216B, 216C, 216D, 216E, namely, tooth 216E (the lower-most tooth), as indicated in FIG. 2. Indeed, because tooth 216E is engaging with and thus contacting lower end 217B, rod return device 217 is held in place, such that rod return device 217 is pivoted counter-clockwise. Optionally, rod return device 217 can be configured and distributed in weight (balanced) in such a way that in this position as shown in FIG. 2 rod return device 217 does not contact any other part of ratchet 113 or any part of rod 114; alternatively, rod 114 can be further held in this position, not only by tooth 216E, but also by contact with tooth 216B and/or rod 114.

In order for seat 102 to be raised from lower position 110 shown in FIG. 2, a user grasps a portion of back end 108 of seat 102 and lifts upwardly in direction of arrow 221. Upon doing so, rod 114 slides down tooth 216B and drops into station 115B under the force of gravity, given the downward slope of front leg 218A of groove 218; that is, front leg 218A slopes downwardly running from a back (rear) portion of front leg 218A to a front portion of front leg 218A (more visible in FIG. 3). Seat 102 will now be seated in intermediate station 115B, if the user chooses to stop there at that height of seat 102. If user wishes to raise seat 102 to the next adjacent height defined by station 115C, user again lifts up on seat 102 at back end 108 and lifts upwardly in direction of arrow 221. Upon doing so, rod 114 slides down tooth 216C and drops into station 115C under the force of gravity, given the downward slope of front leg 218A. Seat 102 will now be seated in intermediate station 115C, if the user chooses to stop there at that height of seat 102. Similarly, if user wishes to raise seat 102 to the next adjacent height defined by station 115D, user again lifts up on seat 102 at back end 108 and lifts upwardly in direction of arrow 221. Upon doing so, rod 114 slides down tooth 216D and drops into station 115D under the force of gravity, given the downward slope of front leg 218A. Seat 102 will now be seated in intermediate station 115D, if the user chooses to stop there at that height of seat 102. Alternatively, a user can rapidly move from a higher station 115 to two or more stations 115 therebelow simply by continuing to lift up back end 108 in direction of arrow 221 until the desired height is reached, as that height corresponds to one of stations 115.

Referring now to FIG. 3, there is shown a perspective view of chair 100 of FIG. 1, more specifically the perspective view being taken from a vantage point at approximately a cross-section taken along line 2-2 in FIG. 1, with portions broken away, except seat 102 has been raised to upper position 320 of seat 102 (the highest position of seat 102, such that user can sit in seat 102). Thus, rod 114 is seated in station 115D (the lower-most station) and is located in front leg 218A of groove 218.

FIG. 3 also shows that rod return device 217 has rotated clockwise about pivot axis 219, and lower end 217B is no longer in contact with tooth 216E. As back end 108 of seat 102 is raised (causing rod 114 to move from station 115A to a lower station 115 such as station 115B), tooth 216D (given a length of tooth 216D) and/or rod 114 (as rod 114 slides down tooth 216D) can make contact with rod return device 217, pushing rod return device 217 right (in FIG. 3) and thereby causing rod return device 217 to rotate clockwise. In rotating clockwise, rod return device 217 can be inhibited from rotating any further clockwise than what is shown in FIG. 3 by any suitable way; for example, a fastener 322, such as a bolt or screw, can be secured to base 101, and a head of fastener 322 can project outwardly from base 101 just enough to make contact with rod return device 217 and thereby prevent rod return device 217 from rotating clockwise any further.

Figure 4:
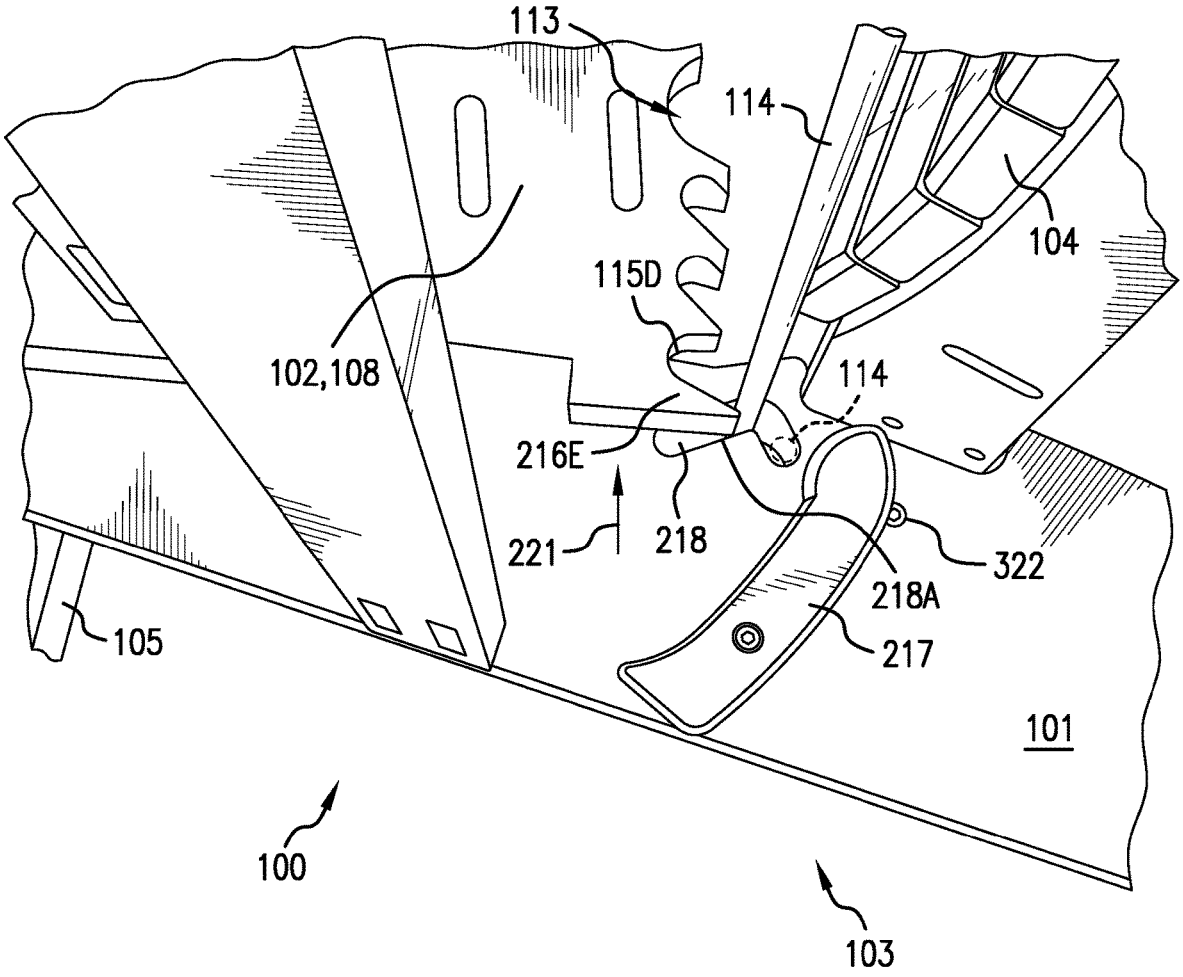
FIG. 4 is a perspective view of the furniture device of FIG. 1, more specifically the perspective view being taken from a vantage point at approximately a cross-section taken along line 2-2 in FIG. 1, with portions broken away, except that the movable device has been raised slightly above the upper position of seat, in accordance with an exemplary embodiment of the present invention.

Referring now to FIG. 4, there is shown a perspective view of chair 100 of FIG. 1, more specifically the perspective view being taken from a vantage point at approximately a cross-section taken along line 2-2 in FIG. 1, with portions broken away, except that back end 108 of seat 102 has been raised in direction of arrow 221 even further than what is shown in FIG. 3. As back end 108 is raised beyond what is shown in FIG. 3, rod 114 slides down tooth 216E. The length of tooth 216E is such that, as back end 108 of seat 102 (and thus ratchet 113) is raised and rod 114 slides down tooth 216E, rod 114 is deposited by tooth 216E in back leg 218B, with the result that rod 114 then slides down back leg 218B, which slopes downwardly running from a front portion of back leg 218B to a back (rear) portion of back leg 218B. FIG. 4 shows rod nearly at the point of being deposited by tooth 216E in back leg 218B. Further, rod 114 in broken lines is also shown seated at a rearmost portion of back leg 218B, after rod 114 has been released by tooth 216E and has slid down back leg 218B.

User then proceeds to pull back end 108 further upwardly in direction of arrow 221 (beyond what is shown in FIG. 4) to an extend substantially similar to what is shown in broken lines in FIG. 1 to raised and released position 111. Upon doing so, user then lowers back end 108 in the opposite direction of arrow 221, in order to reseat rod 114 in a station 115, such as station 115A.

Figure 5:
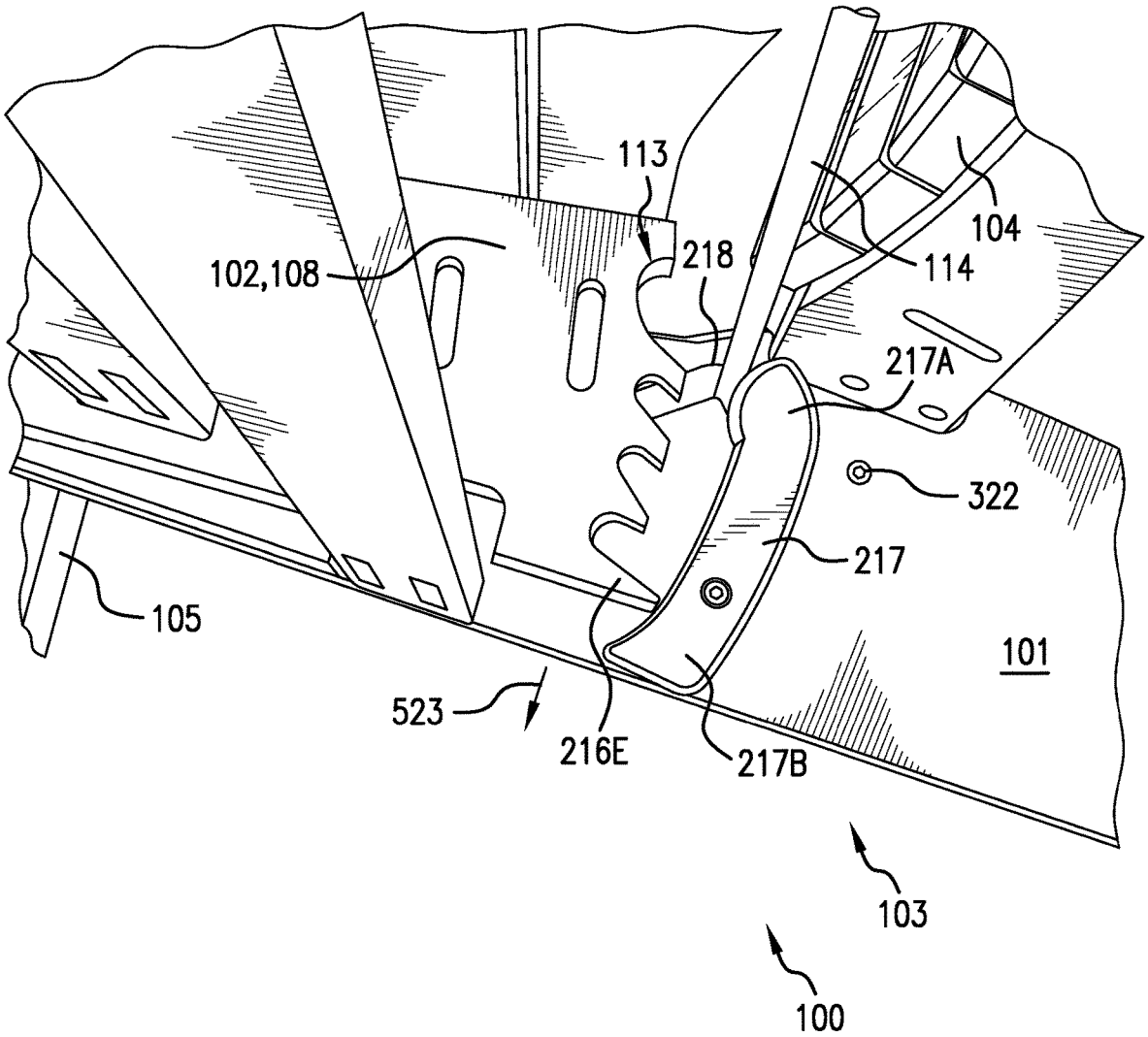
FIG. 5 is a perspective view of the furniture device of FIG. 1, more specifically the perspective view being taken from a vantage point at approximately a cross-section taken along line 2-2 in FIG. 1, with portions broken away, except that the movable device has been lowered relative to FIG. 4, in accordance with an exemplary embodiment of the present invention.

Referring now to FIG. 5, there is shown a perspective view of chair 100 of FIG. 1, more specifically the perspective view being taken from a vantage point at approximately a cross-section taken along line 2-2 in FIG. 1, with portions broken away, except that back end 108 of seat 102 has been lowered in direction of arrow 523 relative to FIG. 4. More specifically, back end 108 has been lowered to the extent that tooth 216E has contacted lower end 217B of rod return device 217, which has caused rod return device 217 to already begin pivoting counter-clockwise about pivot axis 219, thereby causing upper end 217A of rod return device 217 to already begin pushing rod 114. In pushing rod 114, upper end 217A pushes rod 114 back up back leg 218B (as shown in FIG. 5) and then down front leg 218A as back end 108 continues to pivot downwardly in direction of arrow 523, such that rod 114 returns to station 115A (as shown in FIG. 2). Thus, upper end 217A of rod return device 217 is configured for engaging rod 114. Thus, ratchet 113 is configured to deliver rod 114 to rod return device 217 and to cause rod return device 217 to return rod 114 to ratchet 113.

Figure 6:
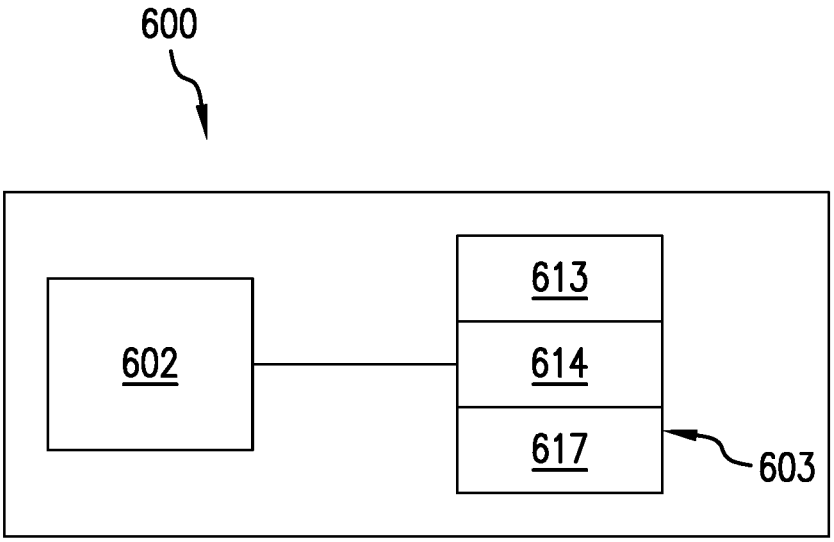
FIG. 6 is shown a schematic diagram of another embodiment of the furniture device, in accordance with an exemplary embodiment of the present invention.
Figure 7:
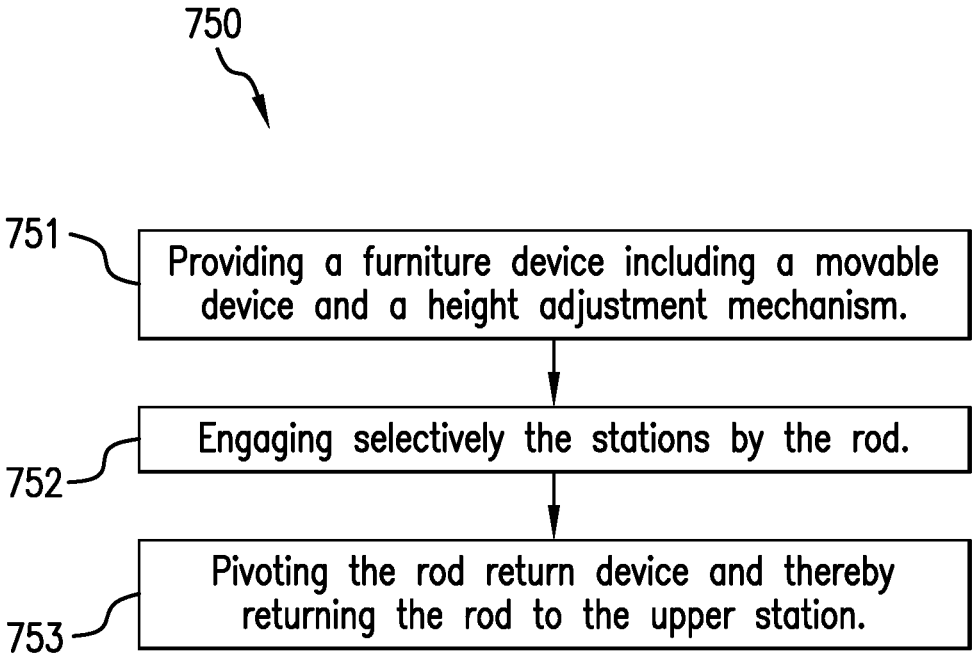
FIG. 7 is a flow diagram showing a method of using a furniture device, in accordance with an exemplary embodiment of the present invention.

Referring now to FIG. 6, there is shown a schematic diagram of another embodiment of the furniture device of the present invention. More specifically, what is shown in FIG. 6 is a generic embodiment of the furniture device of the present invention and thus includes but is not limited to chair 100. Thus, the reference characters of certain structures of the furniture device have been raised by multiples of 100, such that the generic furniture device in FIG. 6 is labeled as furniture device 600. Furniture device 600 thus includes: a movable device 602 and a height adjustment mechanism 603 which is operably coupled with movable device 602 and configured for supporting movable device 602 in a plurality of positions including a lower position and an upper position, height adjustment mechanism 602 including: a ratchet 613 defining a plurality of stations including a lower station and an upper station corresponding respectively to the upper position and lower position; a rod 614 configured for selectively engaging the plurality of stations; and a rod return device 617 configured for pivoting and thereby for returning rod 614 to the upper station. Furniture device 600 thus can be any furniture that has a movable device 602 and a height adjustment mechanism 603 that is used to adjust movable device 602 in height (which can include tilt). Furniture device 600 can be, for example, a chair (as in chair 100), a table that includes a table top to be adjusted in height, or another type of furniture.

In use, user can cycle through the actions shown progressively in FIGS. 1-5. That is, rod in station 115A, user can raise back end 108 of seat 102 manually, which causes rod 114 to shift to station 115B. User can select which station 115 user would like rod 114 to be in, which corresponds to the height of back end 108. When user wishes to return back end 108 to station 115A, user can lift back end 108 all the way up to raised and release position 111, which causes rod 114 to shift position all the way to the right in back leg 218B of groove 218. When user lowers back end 108, back end 108 will be lowered far enough such that tooth 216E strikes lower end 217B, which causes rod return device 217 to pivot counter-clockwise, which causes upper end 217A to move rod 114 back to station 115A.

Referring now to FIG. 8, there is shown a method 750 of using a furniture device 100, 600, the method 750 including the steps of: providing 752 the furniture device 100 which includes a movable device 102, 602 and a height adjustment mechanism 103, 603 operably coupled with the movable device 102, 602 and configured for supporting the movable device 102, 602 in a plurality of positions including a lower position 110 and an upper position 320, the height adjustment mechanism 103, 603 including a ratchet 113, 613, a rod 114, 614, and a rod return device 217, 617, the ratchet 113, 613 defining a plurality of stations 115 including a lower station 115D and an upper station 115A corresponding respectively to the upper position 320 and the lower position 110; engaging 752 selectively, by the rod 114, 614, the plurality of stations 115; and pivoting 753 the rod return device 217, 617 and thereby returning the rod 114, 614 to the upper station 115A. Furniture device 100, 600 further includes a base 101, wherein the movable device 102, 602 forms the ratchet 113, 613, and the rod 114, 614 and the rod return device 217, 617 are each coupled with the base 101. The ratchet 113, 613 includes a plurality of teeth 216A, 216B, 216C, 216D, 216E which define the plurality of stations 115 therebetween. The base 101 defines a groove 218 which has an angular configuration, the rod 114, 614 including an end which is configured for sliding within the groove 218. The rod return device 217, 617 is pivotably coupled with the base 101 and includes an upper end 217A and a lower end 217B, the upper end 217A being configured for engaging the rod 114, 614, the lower end 217B being configured for being engaged by a respective one of the plurality of teeth 216A, 216B, 216C, 216D, 216E. The furniture device 100, 600 is a chair 100, 600, and the movable device 102, 602 is a seat 102, 602.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A furniture device, comprising:

a movable device;

a height adjustment mechanism operably coupled with the movable device and configured for supporting the movable device in a plurality of positions including a lower position and an upper position, the height adjustment mechanism including:

a ratchet defining a plurality of stations including a lower station and an upper station corresponding respectively to the upper position and the lower position, the upper station being located above the lower station, the movable device forming the ratchet, the ratchet including a plurality of teeth which define the plurality of stations therebetween;

a rod configured for selectively engaging the plurality of stations; and a rod return device configured for pivoting and thereby for returning the rod to the upper station; and a base, the rod and the rod return device each being coupled with the base, the base defining a groove which has an angular configuration, the rod including an end which is configured for sliding within the groove.

2. The furniture device of claim 1, wherein the rod return device is pivotably coupled with the base and includes an upper end and a lower end, the upper end being configured for engaging the rod, the lower end being configured for being engaged by a respective one of the plurality of teeth.

3. The furniture device of claim 2, wherein the furniture device is a chair, and the movable device is a seat.

4. A height adjustment mechanism of a furniture device, the furniture device including a movable device, the height adjustment mechanism being operably coupled with the movable device and configured for supporting the movable device in a plurality of positions including a lower position and an upper position, the height adjustment mechanism comprising:

a ratchet defining a plurality of stations including a lower station and an upper station corresponding respectively to the upper position and the lower position, the upper station being located above the lower station, the movable device forming the ratchet, the ratchet including a plurality of teeth which define the plurality of stations therebetween;

a rod configured for selectively engaging the plurality of stations; and a rod return device configured for pivoting and thereby for returning the rod to the upper station, the rod and the rod return device each being configured for being coupled with a base of the furniture device, the rod including an end which is configured for sliding within a groove which the base defines and which has an angular configuration.

5. The height adjustment mechanism of claim 4, wherein the rod return device is configured for being pivotably coupled with the base and includes an upper end and a lower end, the upper end being configured for engaging the rod, the lower end being configured for being engaged by a respective one of the plurality of teeth.

6. The height adjustment mechanism of claim 5, wherein the height adjustment mechanism is configured for being a part of the furniture device which is a chair, of which the movable device is a seat.

7. A method of using a furniture device, the method comprising the steps of:

providing the furniture device which includes a movable device and a height adjustment mechanism operably coupled with the movable device and configured for supporting the movable device in a plurality of positions including a lower position and an upper position, the height adjustment mechanism including a ratchet, a rod, and a rod return device, the ratchet defining a plurality of stations including a lower station and an upper station corresponding respectively to the upper position and the lower position, the upper station being located above the lower station, the movable device forming the ratchet, the ratchet including a plurality of teeth which define the plurality of stations therebetween, the furniture device further including a base, the rod and the rod return device each being coupled with the base, the base defining a groove which has an angular configuration, the rod including an end which is configured for sliding within the groove;

engaging selectively, by the rod, the plurality of stations; and pivoting the rod return device and thereby returning the rod to the upper station.

8. The method of claim 7, wherein the rod return device is pivotably coupled with the base and includes an upper end and a lower end, the upper end being configured for engaging the rod, the lower end being configured for being engaged by a respective one of the plurality of teeth.

9. The method of claim 8, wherein the furniture device is a chair, and the movable device is a seat.

* * * * *